US009177710B2

(12) United States Patent
Lee et al.

(10) Patent No.: US 9,177,710 B2
(45) Date of Patent: Nov. 3, 2015

(54) SMD TRANSFORMER STRUCTURE AND SMD TRANSFORMER ARRAY

(71) Applicant: INPAQ TECHNOLOGY CO., LTD., Miaoli County (TW)

(72) Inventors: Wei-Chih Lee, New Taipei (TW); Cgia-Uch Wu, New Taipei (TW)

(73) Assignee: INPAQ TECHNOLOGY CO., LTD., Miaoli County (TW)

( * ) Notice: Subject to any disclaimer, the term of this patent is extended or adjusted under 35 U.S.C. 154(b) by 53 days.

(21) Appl. No.: 14/100,824

(22) Filed: Dec. 9, 2013

(65) Prior Publication Data

US 2015/0162121 A1 Jun. 11, 2015

(51) Int. Cl.

| | |
|---|---|
| ***H01F 27/02*** | (2006.01) |
| ***H01F 27/06*** | (2006.01) |
| ***H01F 27/26*** | (2006.01) |
| ***H01F 27/28*** | (2006.01) |

(52) U.S. Cl.

CPC ..... *H01F 27/06* (2013.01); *H01F 27/26* (2013.01); *H01F 27/2823* (2013.01); *H01F 27/2885* (2013.01)

(58) Field of Classification Search

CPC ..... H01F 27/02; H01F 27/24; H01F 27/28; H01F 27/29; H01F 27/30

USPC ..... 336/192, 83, 211–219

See application file for complete search history.

(56) References Cited

U.S. PATENT DOCUMENTS

| | | | | |
|---|---|---|---|---|
| 7,009,484 | B2 * | 3/2006 | Gray et al. | 336/192 |
| 7,791,444 | B2 * | 9/2010 | Tomonari et al. | 336/192 |
| 7,932,803 | B2 * | 4/2011 | Hirai | 336/220 |
| 8,937,522 | B2 * | 1/2015 | Lai et al. | 336/192 |
| 2008/0309445 | A1 * | 12/2008 | Suzuki et al. | 336/183 |

* cited by examiner

*Primary Examiner* — Tuyen Nguyen

(74) *Attorney, Agent, or Firm* — Li & Cai Intellectual Property (USA) Office

(57) ABSTRACT

A SMD transformer structure includes a substrate unit, a magnetic unit, a coil unit and a shielding unit. The substrate unit includes a support substrate. The magnetic unit includes at least one magnetic material core bar disposed on the support substrate. The coil unit includes at least one transformer coil assembly wound around the magnetic material core bar. The transformer coil assembly includes a plurality of transformer coils wound around the magnetic material core bar, and each transformer coil has two opposite end portions respectively and electrically connected to the corresponding first electrode and the corresponding second electrode of the substrate unit. The shielding unit includes at least one magnetic shielding board disposed on the magnetic material core bar. Whereby, the SMD transformer structure not only can be simplified to reduce its size, but also can be automatically manufactured to increase its production efficiency and product yield (reliability).

12 Claims, 16 Drawing Sheets

SMD TRANSFORMER STRUCTURE AND SMD TRANSFORMER ARRAY

BACKGROUND OF THE INVENTION

1. Field of the Invention

The instant disclosure relates to a transformer structure and a transformer array, and more particularly to a SMD (Surface Mount Device) transformer structure and a SMD transformer array.

2. Description of Related Art

There is an accelerating trend toward higher speed and greater capacity in communications on the Internet, local area networks (LAN), and other communication fields. In the background of this trend is development of a broad array of new transmission systems and ICs (integrated circuits) in conjunction with the digitalization of transmission signals. Among these developments, one indispensable electronic device is the pulse transformer (broadband transmission transformer) for use in communications, and there is a need for characteristics that accommodate the rapid progress of communications technologies.

SUMMARY OF THE INVENTION

One aspect of the instant disclosure relates to a SMD transformer structure and a SMD transformer array.

One of the embodiments of the instant disclosure provides a SMD transformer structure, comprising: a substrate unit, a magnetic unit, a coil unit and a shielding unit. The substrate unit includes a support substrate, a plurality of first electrodes disposed on the support substrate, and a plurality of second electrodes disposed on the support substrate and respectively corresponding to the first electrodes. The magnetic unit includes at least one magnetic material core bar disposed on the support substrate. The coil unit includes at least one transformer coil assembly wound around the at least one magnetic material core bar, wherein the at least one transformer coil assembly includes a plurality of transformer coils adjacent to each other and wound around the at least one magnetic material core bar, and each transformer coil has two opposite end portions respectively and electrically connected to the corresponding first electrode and the corresponding second electrode. The shielding unit includes at least one magnetic shielding board disposed on the at least one magnetic material core bar, wherein both the at least one magnetic material core bar and the at least one transformer coil assembly are disposed between the support substrate and the at least one magnetic shielding board.

More precisely, the at least one magnetic material core bar has two support portions disposed between the support substrate and the at least one magnetic shielding board and a connection portion connected between the two support portions and suspended between the support substrate and the at least one magnetic shielding board, and the at least one transformer coil assembly is wound around the connection portion of the at least one magnetic material core bar and disposed between the two support portions of the at least one magnetic material core bar.

Another one of the embodiments of the instant disclosure provides a SMD transformer array, comprising: a substrate unit, a magnetic unit, a coil unit and a shielding unit. The substrate unit includes a support substrate, a plurality of first electrodes disposed on the support substrate, and a plurality of second electrodes disposed on the support substrate and respectively corresponding to the first electrodes. The magnetic unit includes at least one magnetic material core bar disposed on the support substrate. The coil unit includes a plurality of transformer coil assemblies separated from each other by a predetermined and wound around the at least one magnetic material core bar, wherein each transformer coil assembly includes a plurality of transformer coils adjacent to each other and wound around the at least one magnetic material core bar, and each transformer coil has two opposite end portions respectively and electrically connected to the corresponding first electrode and the corresponding second electrode. The shielding unit includes at least one magnetic shielding board disposed on the at least one magnetic material core bar, wherein both the at least one magnetic material core bar and the transformer coil assemblies are disposed between the support substrate and the at least one magnetic shielding board.

More precisely, the at least one magnetic material core bar has two support portions disposed between the support substrate and the at least one magnetic shielding board and a connection portion connected between the two support portions and suspended between the support substrate and the at least one magnetic shielding board, and the transformer coil assemblies are wound around the connection portion of the at least one magnetic material core bar and disposed between the two support portions of the at least one magnetic material core bar.

Yet another one of the embodiments of the instant disclosure provides a SMD transformer array, comprising: a substrate unit, a magnetic unit, a coil unit and a shielding unit. The substrate unit includes a support substrate, a plurality of first electrodes disposed on the support substrate, and a plurality of second electrodes disposed on the support substrate and respectively corresponding to the first electrodes. The magnetic unit includes a plurality of magnetic material core bars disposed on the support substrate. The coil unit includes a plurality of transformer coil assemblies respectively wound around the magnetic material core bars, wherein each transformer coil assembly includes a plurality of transformer coils adjacent to each other and wound around the corresponding magnetic material core bar, and each transformer coil has two opposite end portions respectively and electrically connected to the corresponding first electrode and the corresponding second electrode. The shielding unit includes a plurality of magnetic shielding boards respectively disposed on the magnetic material core bars, wherein each magnetic material core bar is disposed between the corresponding support substrate and the corresponding magnetic shielding board, and each transformer coil assembly is disposed between the corresponding support substrate and the corresponding magnetic shielding board.

More precisely, each magnetic material core bar has two support portions disposed between the support substrate and the corresponding magnetic shielding board and a connection portion connected between the two support portions and suspended between the support substrate and the corresponding magnetic shielding board, and each transformer coil assembly is wound around the connection portion of the corresponding magnetic material core bar and disposed between the two support portions of the corresponding magnetic material core bar.

Therefore, the coil unit includes at least one transformer coil assembly wound around the magnetic material core bar as shown in one of the embodiments, the coil unit includes a plurality of transformer coil assemblies separated from each other by a predetermined and wound around the at least one magnetic material core bar as shown in another one of embodiments, and the coil unit includes a plurality of transformer coil assemblies respectively wound around the magnetic material core bars as shown in yet another one of embodiments, thus the SMD transformer structure and the SMD transformer array of the instant disclosure not only can be simplified to reduce its size, but also can be automatically manufactured to increase its production efficiency and product yield (reliability).

To further understand the techniques, means and effects of the instant disclosure applied for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

First Embodiment

Figure 1A:
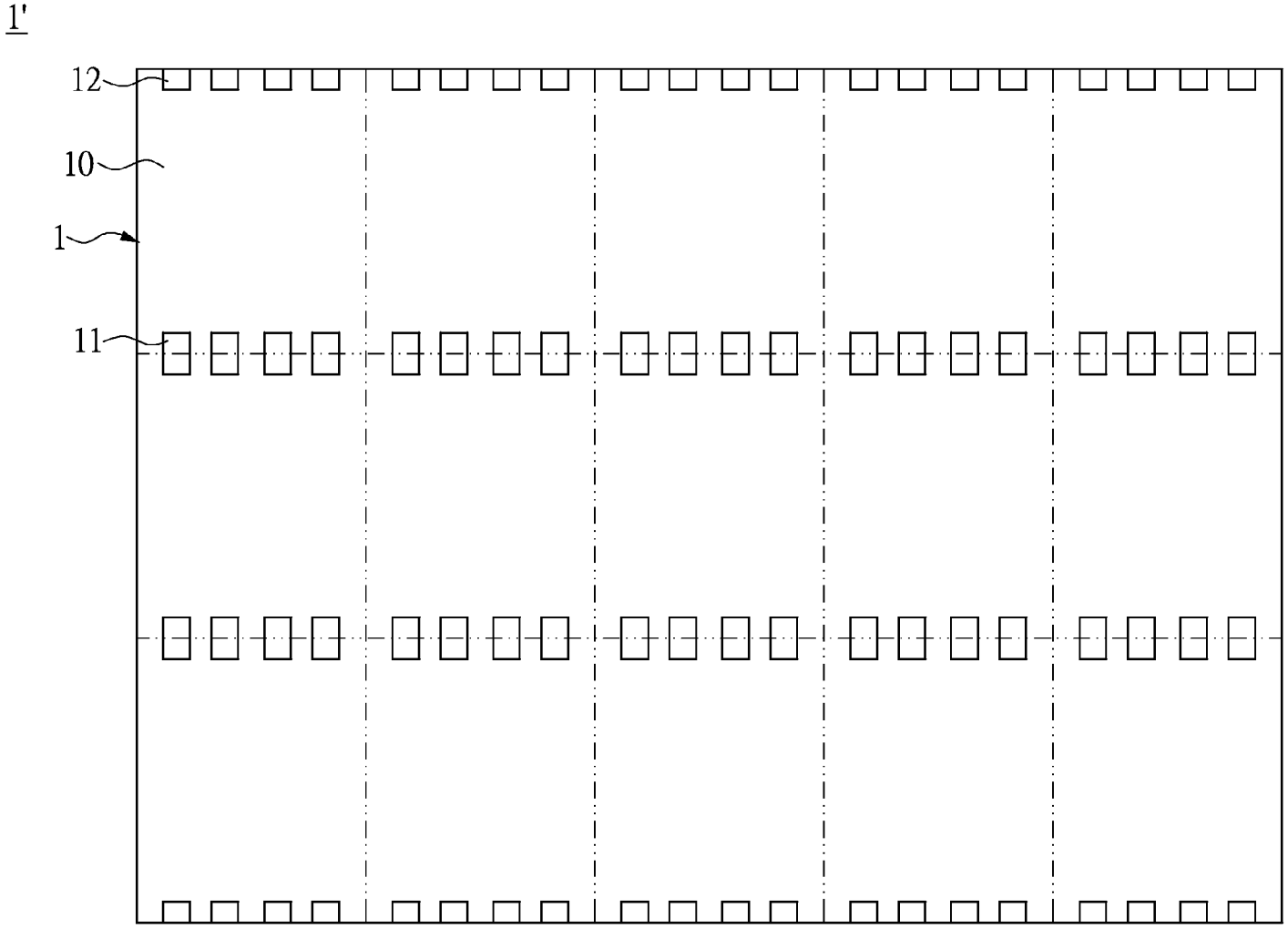
FIG. 1A shows a top, schematic diagram of the carrier substrate according to the first embodiment of the instant disclosure.

Referring to FIG. 1A to FIG. 1E, where the first embodiment of the instant disclosure provides a method for manufacturing a SMD transformer structure Z1, comprising the following steps:

First, referring to FIG. 1A, a carrier substrate 1' is provided. The carrier substrate 1' includes a plurality of substrate units 1 imaginatively divided by the imaginary lines as shown in FIG. 1A, and each substrate unit 1 includes a support substrate 10, a plurality of first electrodes 11 (such as positive electrodes made of any metal material) disposed on the support substrate 10, and a plurality of second electrodes 12 (such as negative electrodes made of any metal material) disposed on the support substrate 10 and respectively corresponding to the first electrodes 11. For example, the support substrate 10 may be a magnetic substrate formed by sintering magnetic powder, and the first electrodes 11 and the second electrodes 12 are via holes or metal pillars passing through the support substrate 10.

Figure 1B:
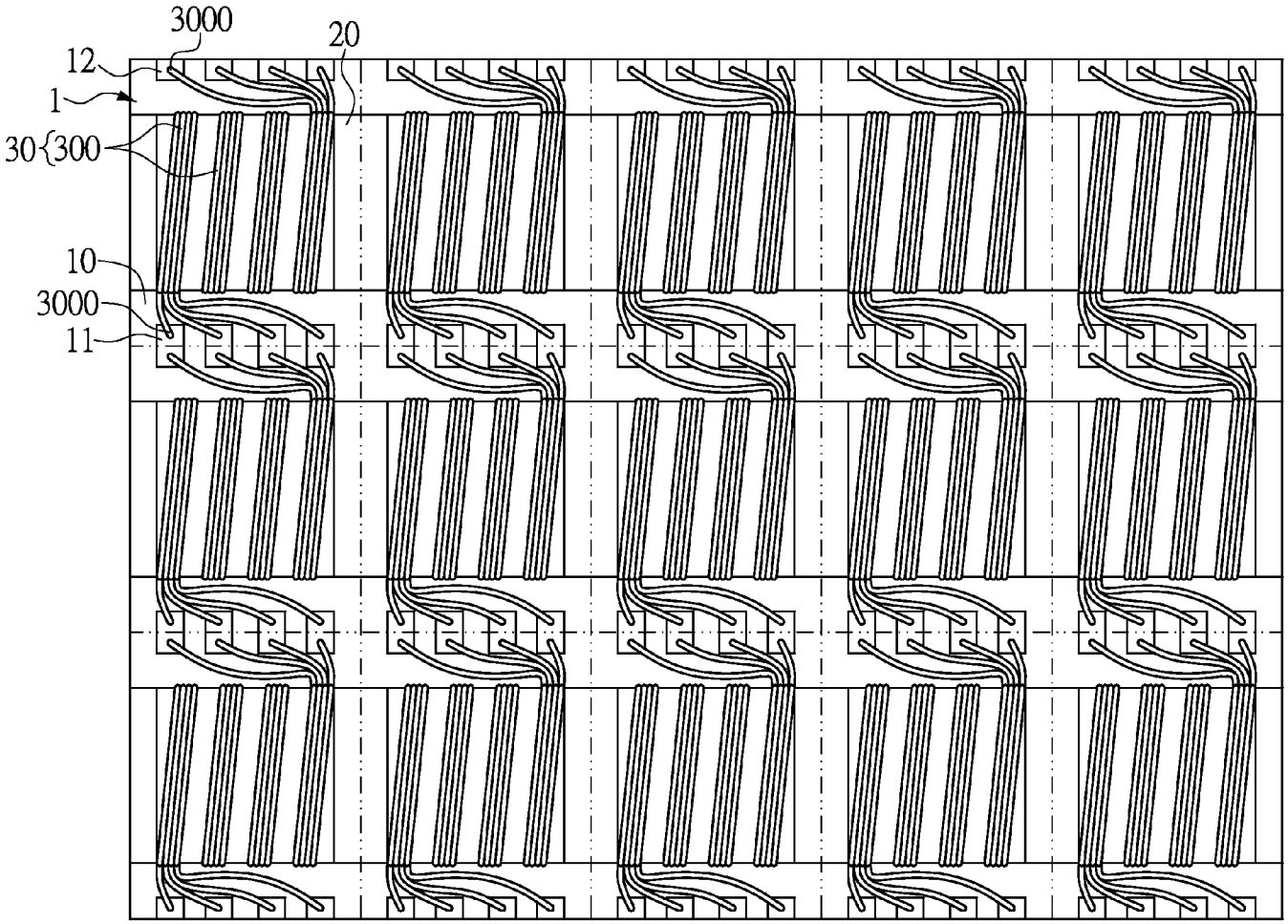
FIG. 1B shows a top, schematic diagram of the transformer coil assemblies respectively wound around the magnetic material core bars and electrically connected to the carrier substrate according to the first embodiment of the instant disclosure.

Next, referring to FIG. 1B, a plurality of magnetic material core bars 20 and a plurality of transformer coil assemblies 30 are provided. Each transformer coil assembly 30 is wound around (or coiled around, surrounding) the corresponding magnetic material core bar 20, and each magnetic material core bar 20 is disposed on the corresponding support substrate 10. In addition, each transformer coil assembly 30 includes a plurality of transformer coils 300 adjacent to each other and wound around the corresponding magnetic material core bar 20, and each transformer coil 300 has two opposite end portions 3000 respectively and electrically connected to the first electrode 11 and the second electrode 12 of the corresponding substrate unit 1. For example, each magnetic material core bar 20 may be formed by sintering magnetic powder, and the two opposite end portions 3000 of each transformer coil 300 are respectively and electrically connected to the first electrode 11 and the second electrode 12 of the corresponding substrate unit 1 by soldering.

Figure 1C:
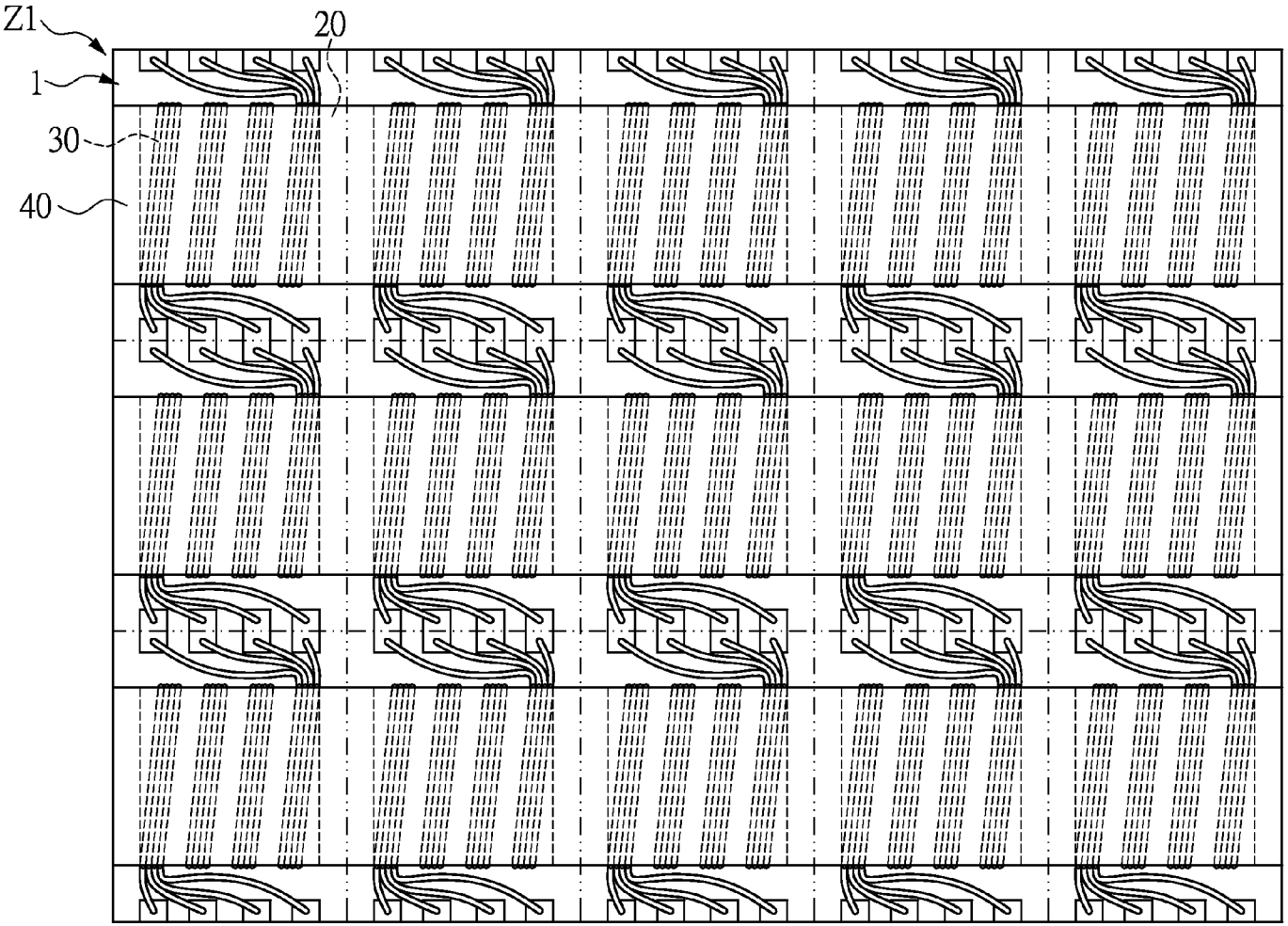
FIG. 1C shows a top, schematic diagram of the magnetic shielding boards respectively disposed on the magnetic material core bars according to the first embodiment of the instant disclosure.
Figure 1D:
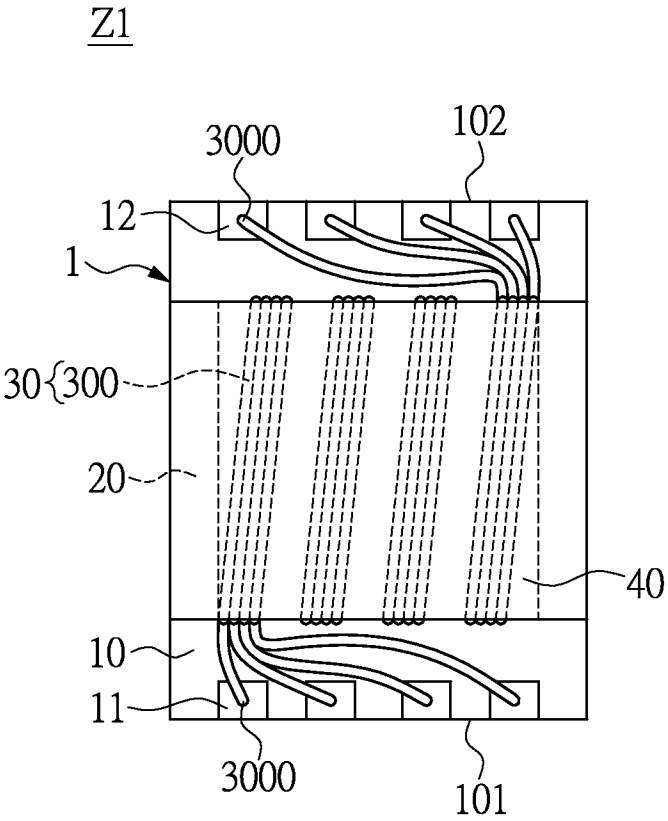
FIG. 1D shows a top, schematic diagram of the SMD transformer structure according to the first embodiment of the instant disclosure.
Figure 1E:
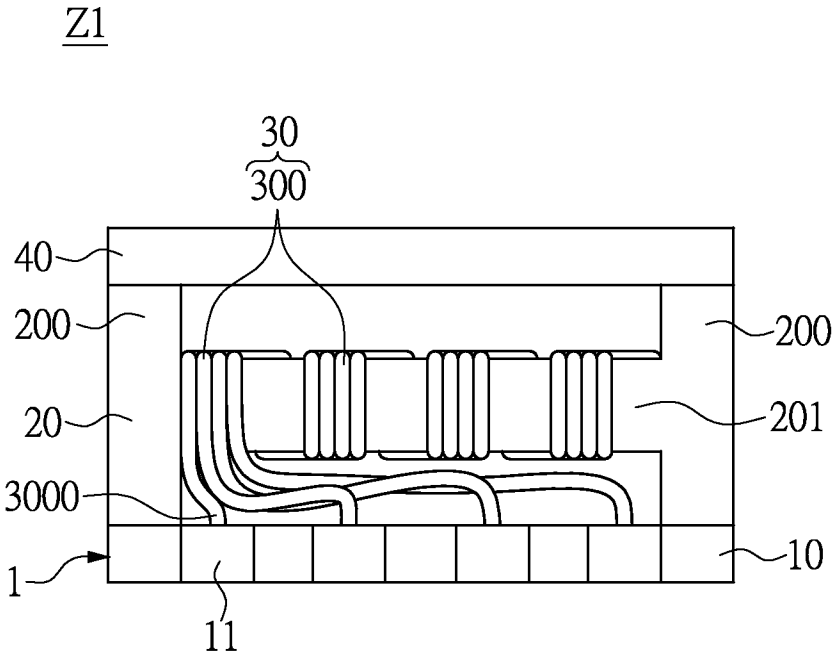
FIG. 1E shows a lateral, schematic diagram of the SMD transformer structure according to the first embodiment of the instant disclosure.

Then, referring to FIG. 1C, FIG. 1D and FIG. 1E, a plurality of magnetic shielding boards 40 are disposed on the magnetic material core bars 20, respectively. The magnetic shielding boards 40 arranged along the same line or all of the magnetic shielding boards 40 are integrated with each other to form a single magnetic shielding plate before cutting process. Finally, the single SMD transformer structure Z1 is finished as shown in FIG. 1D and FIG. 1E by cutting along the imaginary lines as shown in FIG. 1C.

Referring to FIG. 1B, it's worth mentioning that the magnetic material core bars 20 arranged along the same line are integrated with each other to form a single magnetic bar body before cutting process. The transformer coil assemblies 30 can be concurrently wound around the same single magnetic bar body, thus the method of the instant disclosure can be applied to the quantity production for increasing the production efficiency of the single SMD transformer structure Z1. Furthermore, referring to FIG. 1E, the magnetic material core bar 20 has two support portions 200 disposed between the support substrate 10 and the magnetic shielding board 40 and a connection portion 201 connected between the two support portions 200 and suspended between the support substrate 10 and the magnetic shielding board 40, and the transformer coil assembly 30 is wound around the connection portion 201 of the magnetic material core bar 20 and disposed between the two support portions 200 of the magnetic material core bar 20. In other words, there is a first concave groove formed between the support substrate 10 and the connection portion 201 of the magnetic material core bar 20, there is a second concave groove formed between the magnetic shielding board 40 and the connection portion 201 of the magnetic material core bar 20, thus the transformer coil assembly 30 can be wound around the connection portion 201 of the magnetic material core bar 20 and restricted between the two support portions 200 of the magnetic material core bar 20, for increasing the product yield and the reliability of the SMD transformer structure Z1. Whereby, the SMD transformer structure Z1 of the instant disclosure not only can be simplified to reduce its size, but also can be automatically manufactured to increase its production efficiency and product yield (reliability).

In conclusion, referring to FIG. 1D, FIG. 1E, FIG. 2A and FIG. 2B, the first embodiment of the instant disclosure provides a SMD transformer structure Z1 according to the above-mentioned method, comprising: a substrate unit 1, a magnetic unit 2, a coil unit 3 and a shielding unit 4. The substrate unit 1 includes a support substrate 10, a plurality of first electrodes 11 disposed on the support substrate 10, and a plurality of second electrodes 12 disposed on the support substrate 10 and respectively corresponding to the first electrodes 11. The magnetic unit 2 includes at least one magnetic material core bar 20 disposed on the support substrate 10. The coil unit 3 includes at least one transformer coil assembly 30 wound around the at least one magnetic material core bar 20. The at least one transformer coil assembly 30 includes a plurality of transformer coils 300 adjacent to each other and wound around the at least one magnetic material core bar 20, and each transformer coil 300 has two opposite end portions 3000 respectively and electrically connected to the corresponding first electrode 11 and the corresponding second electrode 12. The shielding unit 4 includes at least one magnetic shielding board 40 disposed on the at least one magnetic material core bar 20, and both the at least one magnetic material core bar 20 and the at least one transformer coil assembly 30 are disposed between the support substrate 10 and the at least one magnetic shielding board 40. Hence, the at least one magnetic material core bar 20, the at least one transformer coil assembly 30 and the at least one magnetic shielding board 40 are applied to the same substrate unit 1 in the first embodiment.

Figure 2A:
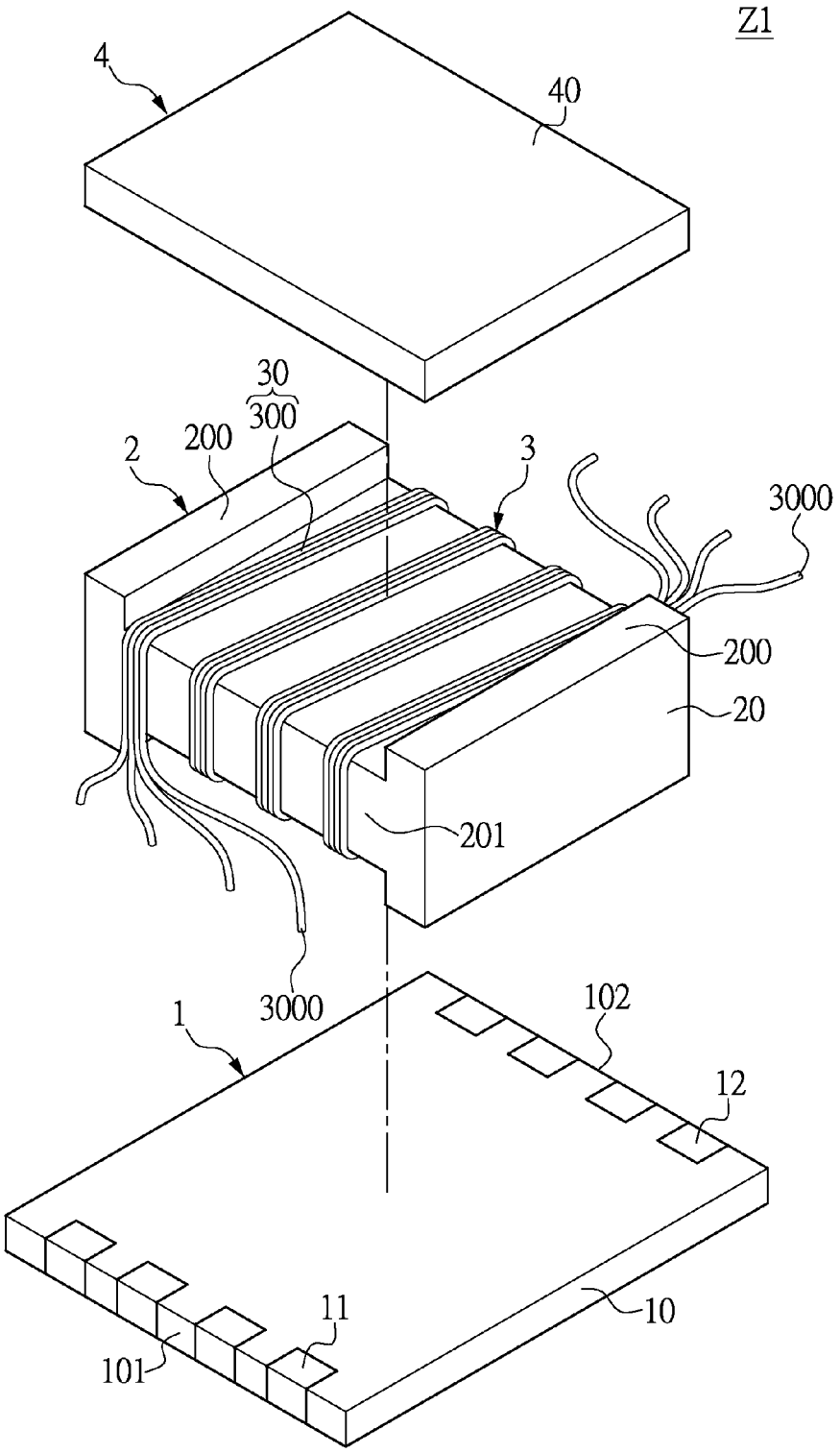
FIG. 2A shows a perspective, exploded, schematic diagram of the SMD transformer structure according to the first embodiment of the instant disclosure.
Figure 2B:
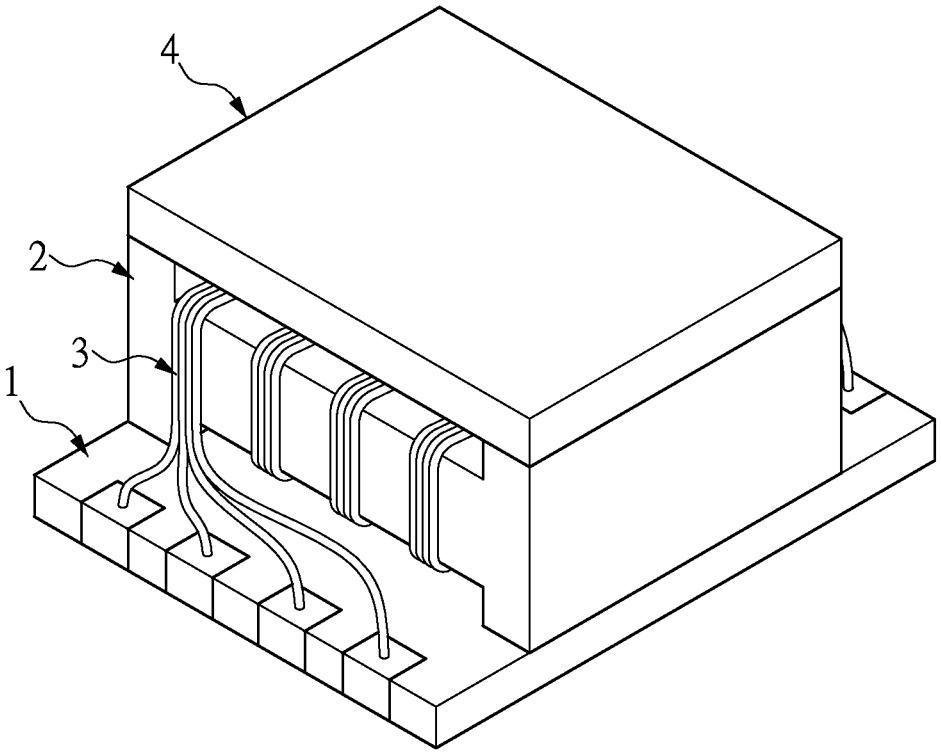
FIG. 2B shows a perspective, assembled, schematic diagram of the SMD transformer structure according to the first embodiment of the instant disclosure.

More precisely, referring to FIG. 1D and FIG. 2A, the support substrate 10 has a first lateral surface 101 and a second lateral surface 102 opposite to the first lateral surface 101, the first electrodes 11 pass through the support substrate 10 and exposed from the first lateral surface 101 of the support substrate 10, and the second electrodes 12 pass through the support substrate 10 and exposed from the second lateral surface 102 of the support substrate 10. In addition, referring to FIG. 1E and FIG. 2A, the at least one magnetic material core bar 20 has two support portions 200 disposed between the support substrate 10 and the at least one magnetic shielding board 40 and a connection portion 201 connected between the two support portions 200 and suspended between the support substrate 10 and the at least one magnetic shielding board 40, and the at least one transformer coil assembly 30 is wound around the connection portion 201 of the at least one magnetic material core bar 20 and disposed between the two support portions 200 of the at least one magnetic material core bar 20. For example, the connection portion 201 of the at least one magnetic material core bar 20 may be a quadrangle prism or a cylinder, but it is merely an example and is not meant to limit the instant disclosure.

Second Embodiment

Figure 3A:
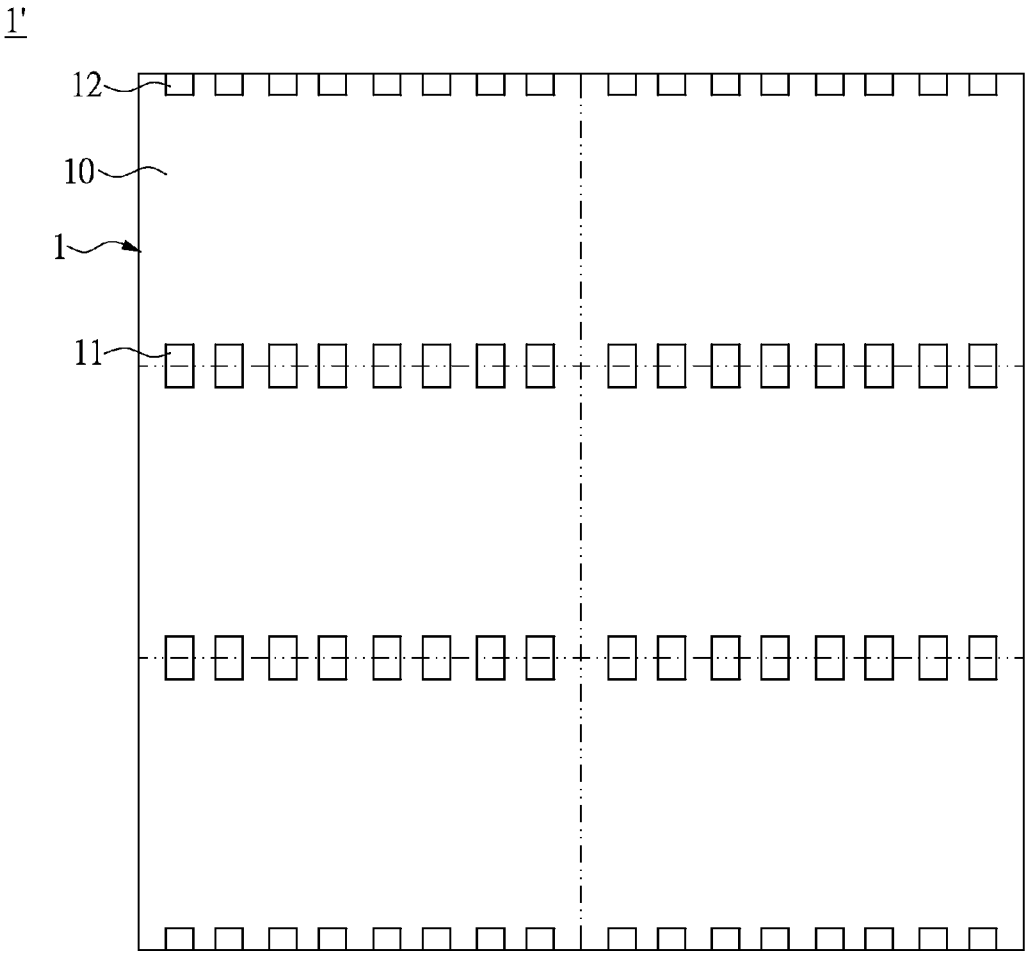
FIG. 3A shows a top, schematic diagram of the carrier substrate according to the second embodiment of the instant disclosure.

Referring to FIG. 3A to FIG. 3E, where the second embodiment of the instant disclosure provides a method for manufacturing a SMD transformer array Z2, comprising the following steps:

First, referring to FIG. 3A, a carrier substrate 1' is provided. The carrier substrate 1' includes a plurality of substrate units 1 imaginatively divided by the imaginary lines as shown in FIG. 3A, and each substrate unit 1 includes a support substrate 10, a plurality of first electrodes 11 (such as positive electrodes made of any metal material) disposed on the support substrate 10, and a plurality of second electrodes 12 (such as negative electrodes made of any metal material) disposed on the support substrate 10 and respectively corresponding to the first electrodes 11. For example, the support substrate 10 may be a magnetic substrate formed by sintering magnetic powder, and the first electrodes 11 and the second electrodes 12 are via holes or metal pillars passing through the support substrate 10.

Figure 3B:
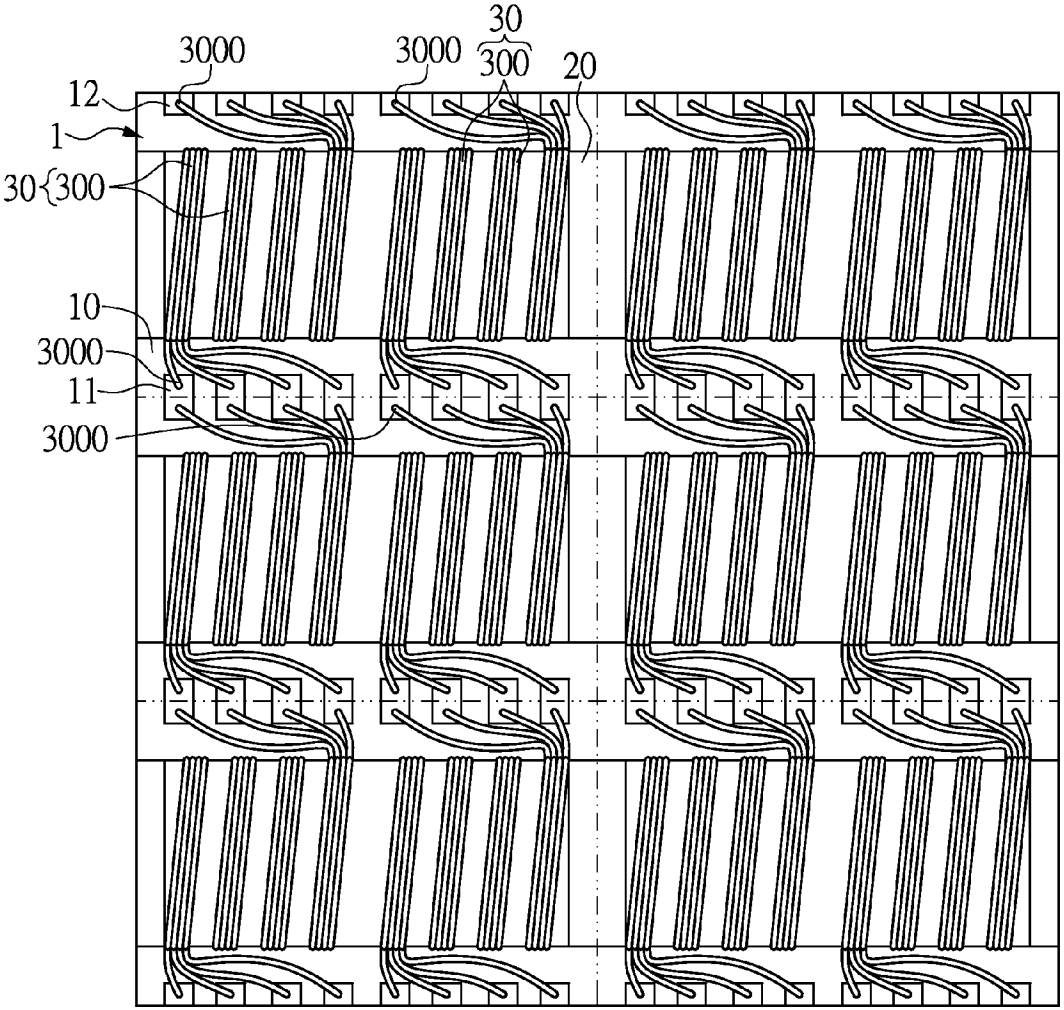
FIG. 3B shows a top, schematic diagram of the at least two transformer coil assemblies wound around the corresponding magnetic material core bar and electrically connected to the carrier substrate according to the second embodiment of the instant disclosure.

Next, referring to FIG. 3B, a plurality of magnetic material core bars 20 and a plurality of transformer coil assemblies 30 are provided. At least two transformer coil assemblies 30 are wound around (or coiled around, surrounding) the corresponding magnetic material core bar 20, and each magnetic material core bar 20 is disposed on the corresponding support substrate 10. In addition, each transformer coil assembly 30 includes a plurality of transformer coils 300 adjacent to each other and wound around the corresponding magnetic material core bar 20, and each transformer coil 300 has two opposite end portions 3000 respectively and electrically connected to the first electrode 11 and the second electrode 12 of the corresponding substrate unit 1. For example, each magnetic material core bar 20 may be formed by sintering magnetic powder, and the two opposite end portions 3000 of each transformer coil 300 are respectively and electrically connected to the first electrode 11 and the second electrode 12 of the corresponding substrate unit 1 by soldering.

Figure 3C:
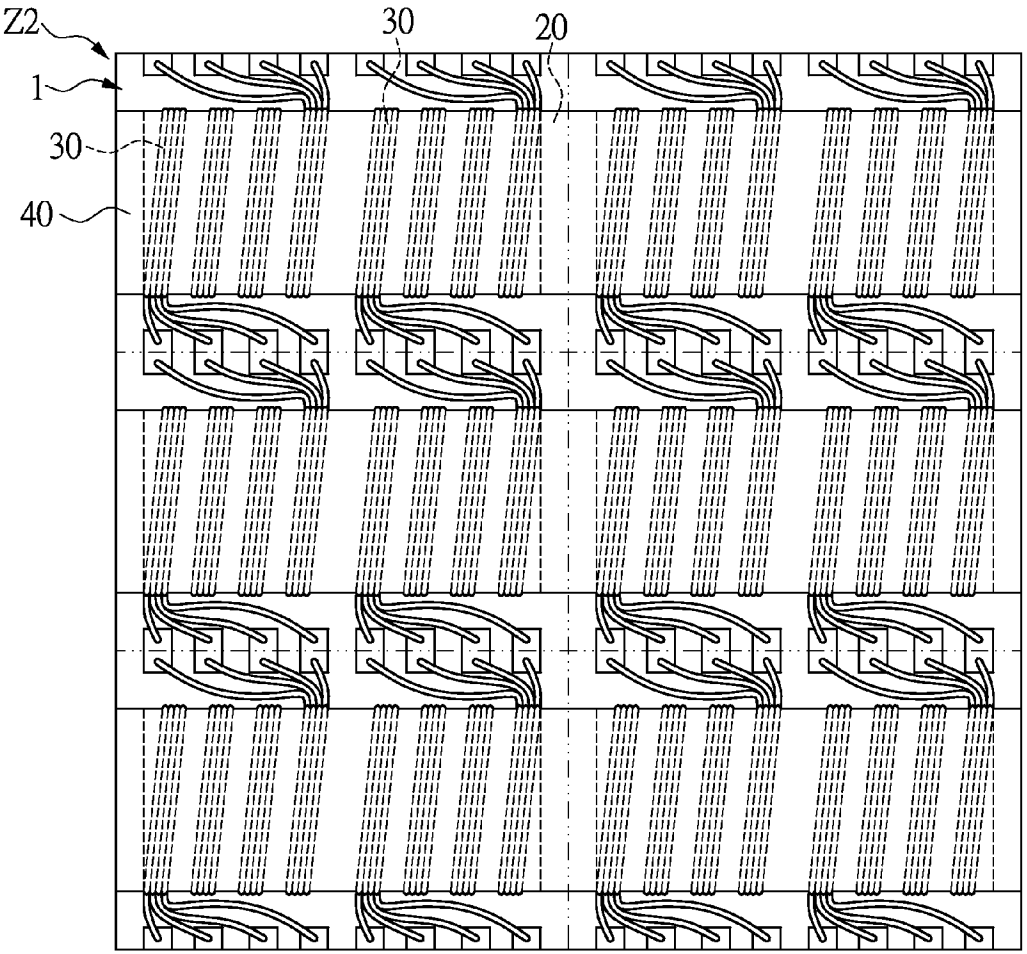
FIG. 3C shows a top, schematic diagram of the magnetic shielding boards respectively disposed on the magnetic material core bars according to the second embodiment of the instant disclosure.
Figure 3D:
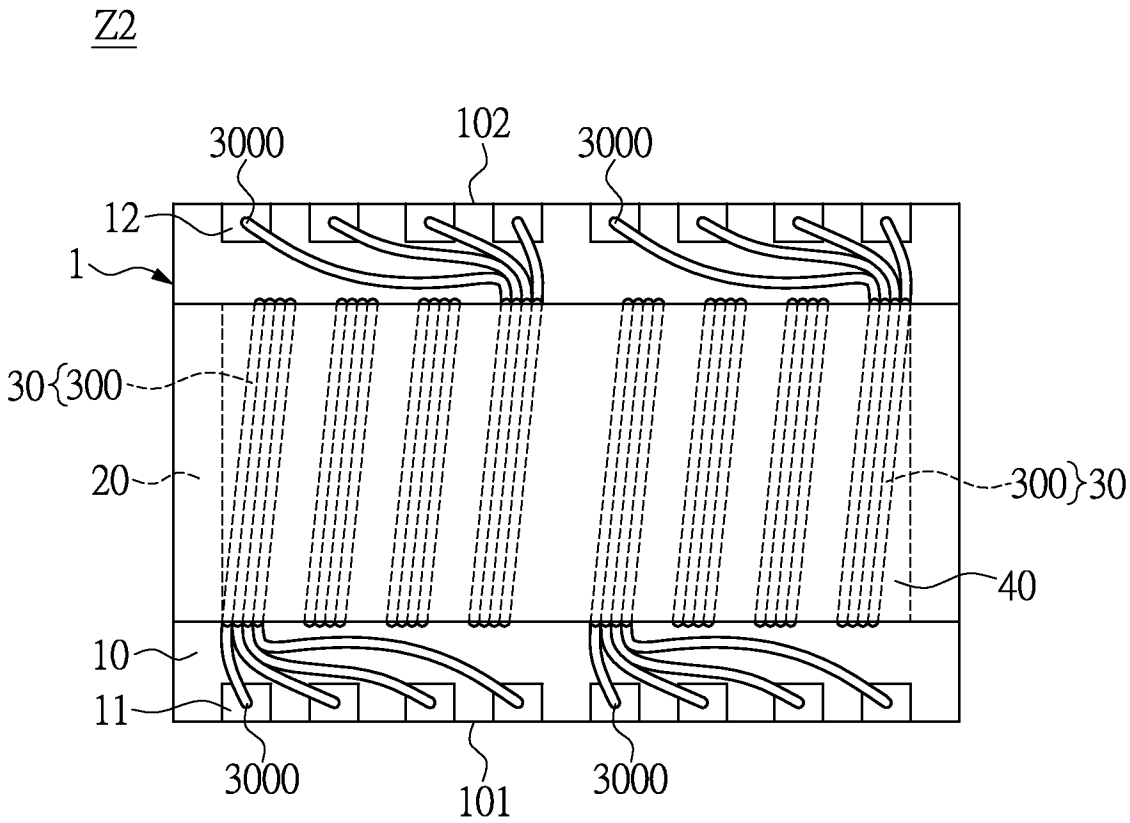
FIG. 3D shows a top, schematic diagram of the SMD transformer structure according to the second embodiment of the instant disclosure.
Figure 3E:
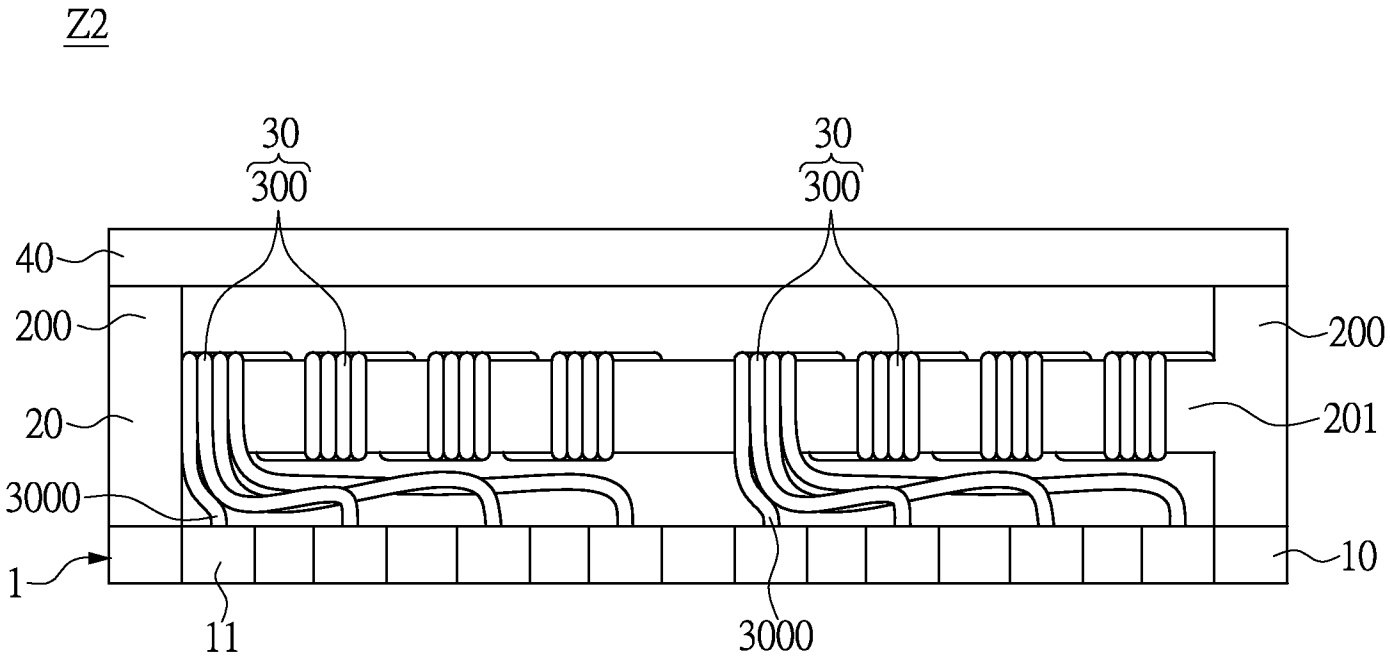
FIG. 3E shows a lateral, schematic diagram of the SMD transformer structure according to the second embodiment of the instant disclosure.

Then, referring to FIG. 3C, FIG. 3D and FIG. 3E, a plurality of magnetic shielding boards 40 are disposed on the magnetic material core bars 20, respectively. The magnetic shielding boards 40 arranged along the same line or all of the magnetic shielding boards 40 are integrated with each other to form a single magnetic shielding plate before cutting process. Finally, the single SMD transformer array Z2 is finished as shown in FIG. 3D and FIG. 3E by cutting along the imaginary lines as shown in FIG. 3C.

Referring to FIG. 3B, it's worth mentioning that the magnetic material core bars 20 arranged along the same line are integrated with each other to form a single magnetic bar body before cutting process. The transformer coil assemblies 30 can be concurrently wound around the same single magnetic bar body, thus the method of the instant disclosure can be applied to the quantity production for increasing the production efficiency of the single SMD transformer array Z2. Furthermore, referring to FIG. 3E, the magnetic material core bar 20 has two support portions 200 disposed between the support substrate 10 and the magnetic shielding board 40 and a connection portion 201 connected between the two support portions 200 and suspended between the support substrate 10 and the magnetic shielding board 40, and the at least two transformer coil assemblies 30 are wound around the connection portion 201 of the magnetic material core bar 20 and disposed between the two support portions 200 of the magnetic material core bar 20. In other words, there is a first concave groove formed between the support substrate 10 and the connection portion 201 of the magnetic material core bar 20, there is a second concave groove formed between the magnetic shielding board 40 and the connection portion 201 of the magnetic material core bar 20, thus the at least two transformer coil assemblies 30 can be wound around the connection portion 201 of the magnetic material core bar 20 and restricted between the two support portions 200 of the magnetic material core bar 20, for increasing the product yield and the reliability of the SMD transformer array Z2. Whereby, the SMD transformer array Z2 of the instant disclosure not only can be simplified to reduce its size, but also can be automatically manufactured to increase its production efficiency and product yield (reliability).

In conclusion, referring to FIG. 3D, FIG. 3E, FIG. 4A and FIG. 4B, the first embodiment of the instant disclosure provides a SMD transformer array Z2 according to the above-mentioned method, comprising: a substrate unit 1, a magnetic unit 2, a coil unit 3 and a shielding unit 4. The substrate unit 1 includes a support substrate 10, a plurality of first electrodes 11 disposed on the support substrate 10, and a plurality of second electrodes 12 disposed on the support substrate 10 and respectively corresponding to the first electrodes 11. The magnetic unit 2 includes at least one magnetic material core bar 20 disposed on the support substrate 10. The coil unit 3 includes a plurality of transformer coil assemblies 30 separated from each other by a predetermined and wound around the at least one magnetic material core bar 20. Each transformer coil assembly 30 includes a plurality of transformer coils 300 adjacent to each other and wound around the at least one magnetic material core bar 20, and each transformer coil 300 has two opposite end portions 3000 respectively and electrically connected to the corresponding first electrode 11 and the corresponding second electrode 12. The shielding unit 4 includes at least one magnetic shielding board 40 disposed on the at least one magnetic material core bar 20, and both the at least one magnetic material core bar 20 and the transformer coil assemblies 30 are disposed between the support substrate 10 and the at least one magnetic shielding board 20. Hence, the at least one magnetic material core bar 20, the transformer coil assemblies 30 and the at least one magnetic shielding board 40 are applied to the same substrate unit 1 in the second embodiment.

Figure 4A:
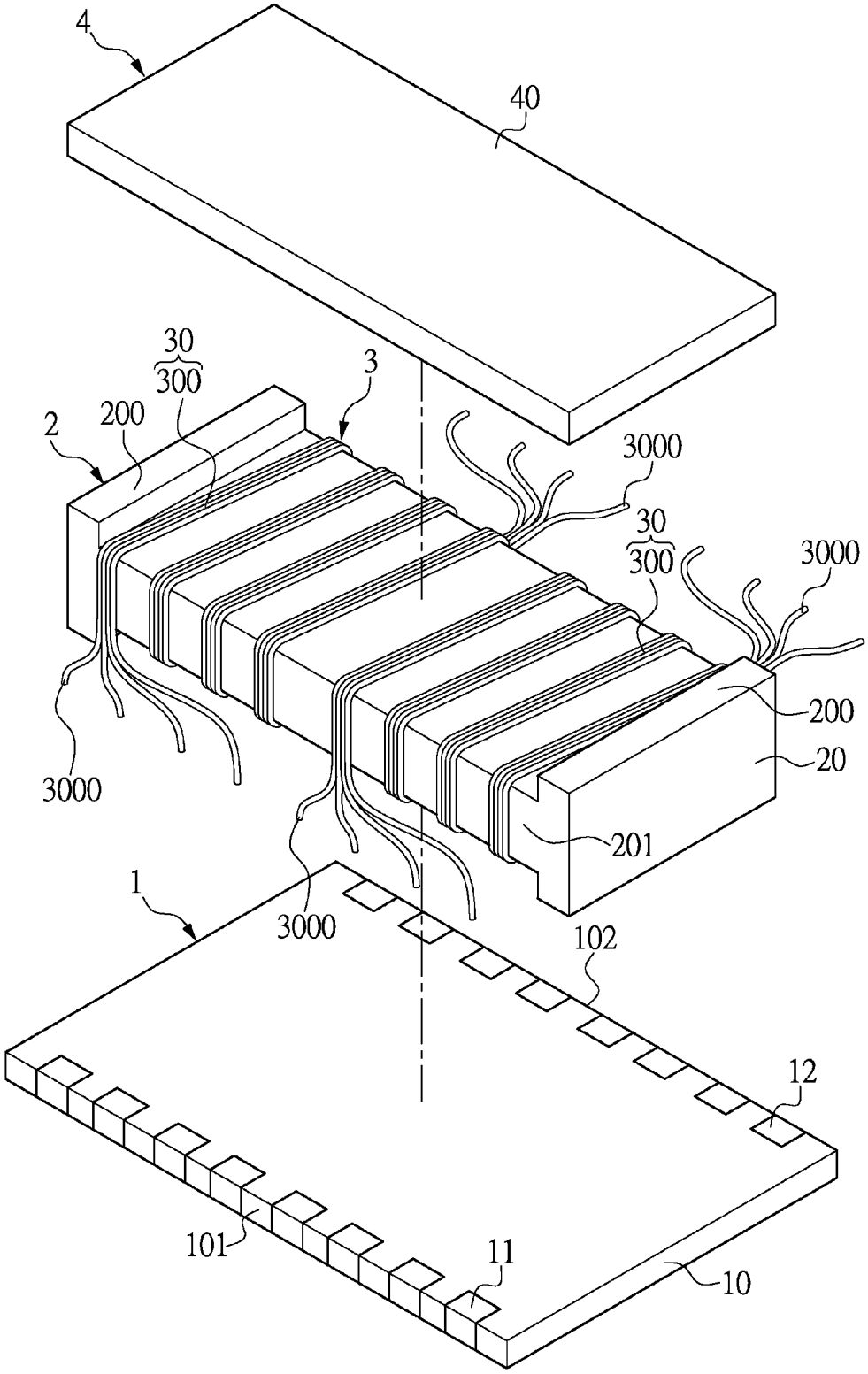
FIG. 4A shows a perspective, exploded, schematic diagram of the SMD transformer structure according to the second embodiment of the instant disclosure.
Figure 4B:
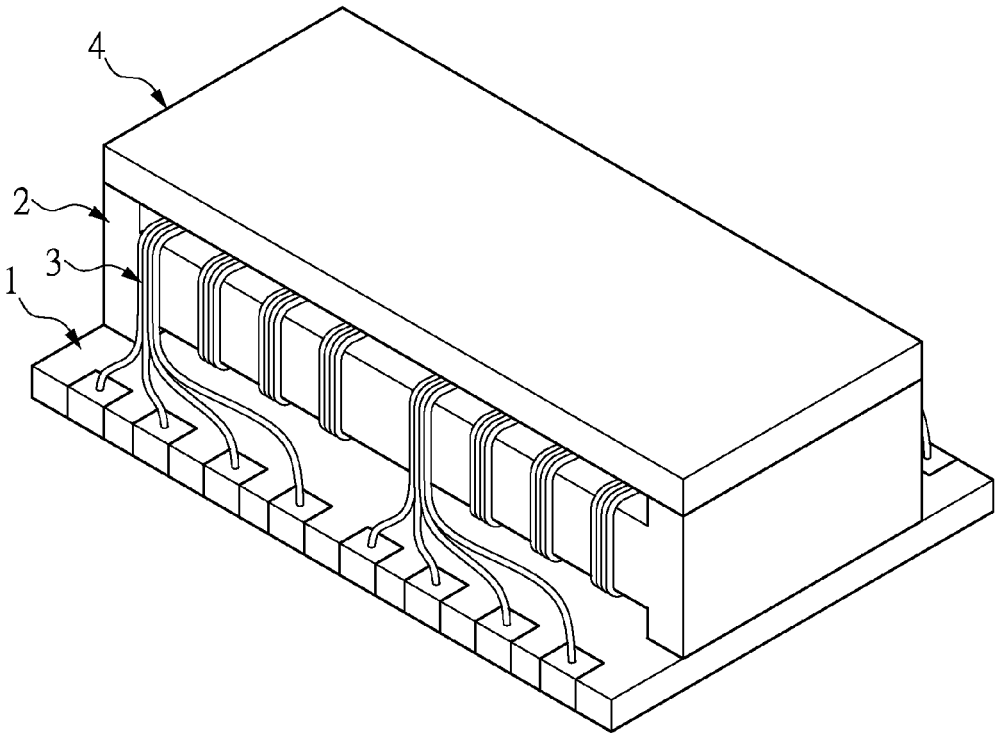
FIG. 4B shows a perspective, assembled, schematic diagram of the SMD transformer structure according to the second embodiment of the instant disclosure.

More precisely, referring to FIG. 3D and FIG. 4A, the support substrate 10 has a first lateral surface 101 and a second lateral surface 102 opposite to the first lateral surface 101, the first electrodes 11 pass through the support substrate 10 and exposed from the first lateral surface 101 of the support substrate 10, and the second electrodes 12 pass through the support substrate 10 and exposed from the second lateral surface 102 of the support substrate 10. In addition, referring to FIG. 1E and FIG. 2A, the at least one magnetic material core bar 20 has two support portions 200 disposed between the support substrate 10 and the at least one magnetic shielding board 40 and a connection portion 201 connected between the two support portions 200 and suspended between the support substrate 10 and the at least one magnetic shielding board 40, and the transformer coil assemblies 30 are wound around the connection portion 201 of the at least one magnetic material core bar 20 and disposed between the two support portions 200 of the at least one magnetic material core bar 20. For example, the connection portion 201 of the at least one magnetic material core bar 20 may be a quadrangle prism or a cylinder, but it is merely an example and is not meant to limit the instant disclosure.

Third Embodiment

Figure 5A:
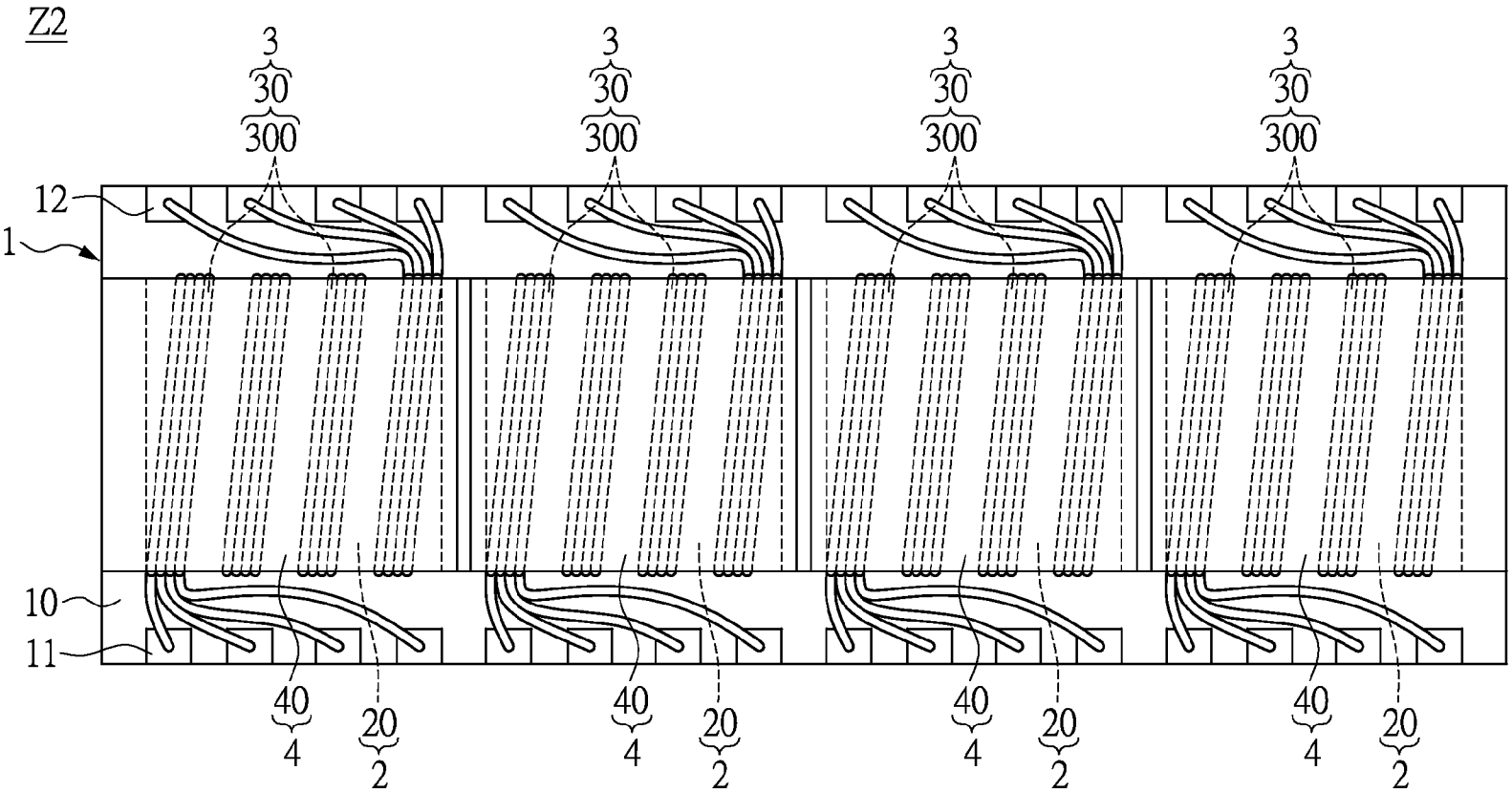
FIG. 5A shows a top, schematic diagram of the SMD transformer structure according to the third embodiment of the instant disclosure.
Figure 5B:
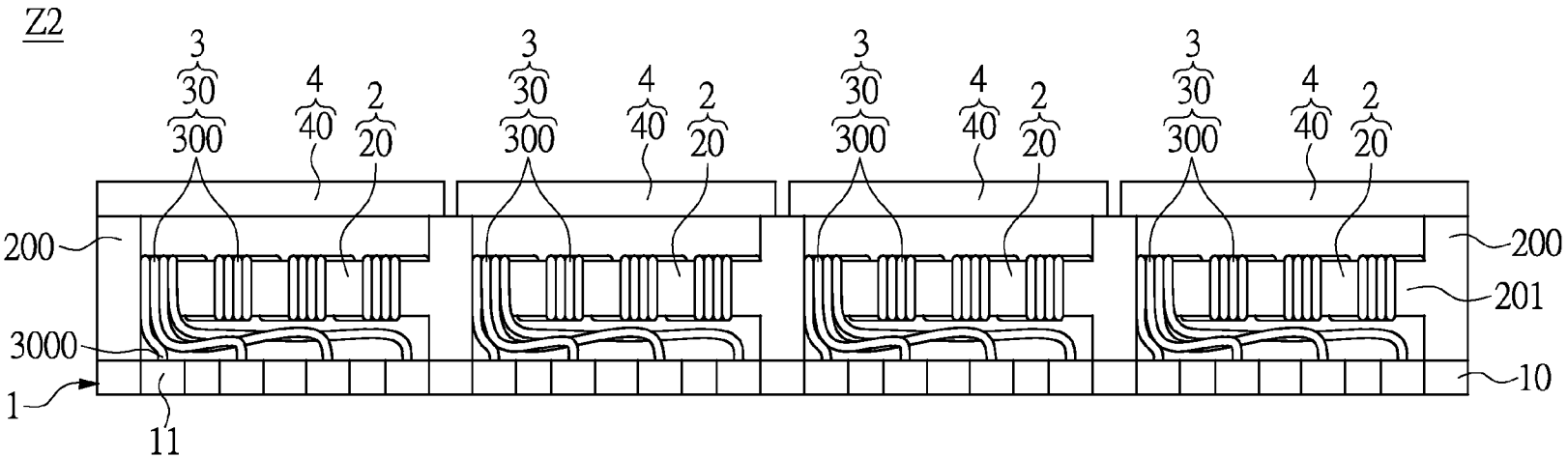
FIG. 5B shows a lateral, schematic diagram of the SMD transformer structure according to the third embodiment of the instant disclosure.

Referring to FIG. 5A and FIG. 5B, the third embodiment of the instant disclosure provides a SMD transformer array Z2 according to the above-mentioned method, comprising: a substrate unit 1, a magnetic unit 2, a coil unit 3 and a shielding unit 4. The substrate unit 1 includes a support substrate 10, a plurality of first electrodes 11 (such as positive electrodes made of any metal material) disposed on the support substrate 10, and a plurality of second electrodes 12 (such as negative electrodes made of any metal material) disposed on the support substrate 10 and respectively corresponding to the first electrodes 11. The magnetic unit 2 includes a plurality of magnetic material core bars 20 disposed on the support substrate 10. The coil unit 3 includes a plurality of transformer coil assemblies 30 respectively wound around the magnetic material core bars 20. Each transformer coil assembly 30 includes a plurality of transformer coils 300 adjacent to each other and wound around the corresponding magnetic material core bar 20, and each transformer coil 300 has two opposite end portions 3000 respectively and electrically connected to the corresponding first electrode 11 and the corresponding second electrode 12. The shielding unit 4 includes a plurality of magnetic shielding boards 40 respectively disposed on the magnetic material core bars 20, and each magnetic material core bar 20 is disposed between the corresponding support substrate 10 and the corresponding magnetic shielding board 40, and each transformer coil assembly 30 is disposed between the corresponding support substrate 10 and the corresponding magnetic shielding board 40. Hence, the magnetic material core bars 20, the transformer coil assemblies 30 and the magnetic shielding boards 40 are applied to the same substrate unit 1 in the third embodiment.

More precisely, the support substrate 10 has a first lateral surface 101 and a second lateral surface 102 opposite to the first lateral surface 101, the first electrodes 11 pass through the support substrate 10 and exposed from the first lateral surface 101 of the support substrate 10, and the second electrodes 12 pass through the support substrate 10 and exposed from the second lateral surface 102 of the support substrate 10. In addition, each magnetic material core bar 20 has two support portions 200 disposed between the support substrate 10 and the corresponding magnetic shielding board 40 and a connection portion 201 connected between the two support portions 200 and suspended between the support substrate 10 and the corresponding magnetic shielding board 40, and each transformer coil assembly 30 is wound around the connection portion 201 of the corresponding magnetic material core bar 20 and disposed between the two support portions 200 of the corresponding magnetic material core bar 20. For example, the connection portion 201 of the at least one magnetic material core bar 20 may be a quadrangle prism or a cylinder, but it is merely an example and is not meant to limit the instant disclosure.

In conclusion, the coil unit 3 includes at least one transformer coil assembly 30 wound around the magnetic material core bar 20 as shown in the first embodiment, the coil unit 3 includes a plurality of transformer coil assemblies 30 separated from each other by a predetermined and wound around the at least one magnetic material core bar 20 as shown in the second embodiment, and the coil unit 3 includes a plurality of transformer coil assemblies 30 respectively wound around the magnetic material core bars 20 as shown in the third embodiment, thus the SMD transformer structure Z1 and the SMD transformer array Z2 of the instant disclosure not only can be simplified to reduce its size, but also can be automatically manufactured to increase its production efficiency and product yield (reliability).

The above-mentioned descriptions merely represent the preferred embodiments of the instant disclosure, without any intention or ability to limit the scope of the instant disclosure which is fully described only within the following claims. Various equivalent changes, alterations or modifications based on the claims of instant disclosure are all, consequently, viewed as being embraced by the scope of the instant disclosure.

What is claimed is:

1. A SMD transformer structure, comprising:

a substrate unit including a support substrate, a plurality of first electrodes disposed on the support substrate, and a plurality of second electrodes disposed on the support substrate and respectively corresponding to the first electrodes;

a magnetic unit including at least one magnetic material core bar disposed on the support substrate;

a coil unit including at least one transformer coil assembly wound around the at least one magnetic material core bar, wherein the at least one transformer coil assembly includes a plurality of transformer coils adjacent to each other and wound around the at least one magnetic material core bar, and each transformer coil has two opposite end portions respectively and electrically connected to the corresponding first electrode and the corresponding second electrode; and a shielding unit including at least one magnetic shielding board disposed on the at least one magnetic material core bar, wherein both the at least one magnetic material core bar and the at least one transformer coil assembly are disposed between the support substrate and the at least one magnetic shielding board;

wherein the at least one magnetic material core bar has two support portions disposed between the support substrate and the at least one magnetic shielding board, the first electrodes and the second electrodes are separated and exposed from the two support portions of the at least one magnetic material core bar, and the two opposite end portions of each transformer coil are separated and exposed from the two support portions of the at least one magnetic material core bar.

2. The SMD transformer structure of claim 1, wherein the support substrate has a first lateral surface and a second lateral surface opposite to the first lateral surface, the first electrodes pass through the support substrate and exposed from the first lateral surface of the support substrate, and the second electrodes pass through the support substrate and exposed from the second lateral surface of the support substrate.

3. The SMD transformer structure of claim 1, wherein the at least one magnetic material core bar has a connection portion connected between the two support portions and suspended between the support substrate and the at least one magnetic shielding board, wherein the at least one transformer coil assembly is wound around the connection portion of the at least one magnetic material core bar and disposed between the two support portions of the at least one magnetic material core bar, and the connection portion of the at least one magnetic material core bar is a quadrangle prism or a cylinder.

4. A SMD transformer array, comprising:

a substrate unit including a support substrate, a plurality of first electrodes disposed on the support substrate, and a plurality of second electrodes disposed on the support substrate and respectively corresponding to the first electrodes;

a magnetic unit including at least one magnetic material core bar disposed on the support substrate;

a coil unit including a plurality of transformer coil assemblies separated from each other by a predetermined and wound around the at least one magnetic material core bar, wherein each transformer coil assembly includes a plurality of transformer coils adjacent to each other and wound around the at least one magnetic material core bar, and each transformer coil has two opposite end portions respectively and electrically connected to the corresponding first electrode and the corresponding second electrode; and a shielding unit including at least one magnetic shielding board disposed on the at least one magnetic material core bar, wherein both the at least one magnetic material core bar and the transformer coil assemblies are disposed between the support substrate and the at least one magnetic shielding board;

wherein the at least one magnetic material core bar has two support portions disposed between the support substrate and the at least one magnetic shielding board, the first electrodes and the second electrodes are separated and exposed from the two support portions of the at least one magnetic material core bar, and the two opposite end portions of each transformer coil are separated and exposed from the two support portions of the at least one magnetic material core bar.

5. The SMD transformer array of claim 4, wherein the support substrate has a first lateral surface and a second lateral surface opposite to the first lateral surface, the first electrodes pass through the support substrate and exposed from the first lateral surface of the support substrate, and the second electrodes pass through the support substrate and exposed from the second lateral surface of the support substrate.

6. The SMD transformer array of claim 4, wherein the at least one magnetic material core bar has a connection portion connected between the two support portions and suspended between the support substrate and the at least one magnetic shielding board, wherein the transformer coil assemblies are wound around the connection portion of the at least one magnetic material core bar and disposed between the two support portions of the at least one magnetic material core bar, and the connection portion of the at least one magnetic material core bar is a quadrangle prism or a cylinder.

7. A SMD transformer array, comprising:

a substrate unit including a support substrate, a plurality of first electrodes disposed on the support substrate, and a plurality of second electrodes disposed on the support substrate and respectively corresponding to the first electrodes;

a magnetic unit including a plurality of magnetic material core bars disposed on the support substrate;

a coil unit including a plurality of transformer coil assemblies respectively wound around the magnetic material core bars, wherein each transformer coil assembly includes a plurality of transformer coils adjacent to each other and wound around the corresponding magnetic material core bar, and each transformer coil has two opposite end portions respectively and electrically connected to the corresponding first electrode and the corresponding second electrode; and a shielding unit including a plurality of magnetic shielding boards respectively disposed on the magnetic material core bars, wherein each magnetic material core bar is disposed between the corresponding support substrate and the corresponding magnetic shielding board, and each transformer coil assembly is disposed between the corresponding support substrate and the corresponding magnetic shielding board;

wherein each magnetic material core bar has two support portions disposed between the support substrate and the corresponding magnetic shielding board, the first electrodes and the second electrodes are separated and exposed from the two support portions of the corresponding magnetic material core bar, and the two opposite end portions of each transformer coil are separated and exposed from the two support portions of the corresponding magnetic material core bar.

8. The SMD transformer array of claim 7, wherein the support substrate has a first lateral surface and a second lateral surface opposite to the first lateral surface, the first electrodes pass through the support substrate and exposed from the first lateral surface of the support substrate, and the second electrodes pass through the support substrate and exposed from the second lateral surface of the support substrate.

9. The SMD transformer array of claim 7, wherein each magnetic material core bar has a connection portion connected between the two support portions and suspended between the support substrate and the corresponding magnetic shielding board, wherein each transformer coil assembly is wound around the connection portion of the corresponding magnetic material core bar and disposed between the two support portions of the corresponding magnetic material core bar, and the connection portion of each magnetic material core bar is a quadrangle prism or a cylinder.

10. The SMD transformer array of claim 7, wherein the first electrodes and the second electrodes are via holes or metal pillars passing through the support substrate.

11. The SMD transformer array of claim 10, wherein the first electrodes are exposed from a top surface, a bottom surface, and a first lateral surface of the support substrate.

12. The SMD transformer array of claim 11, wherein the second electrodes are exposed from the top surface, the bottom surface, and a second lateral surface of the support substrate, and the first lateral surface and the second lateral surface are opposite to each other.

* * * * *